United States Patent [19]

Cellini

[11] 4,094,031

[45] June 13, 1978

[54] CLEANING APPARATUS FOR SELECTED SMALL AREAS OF A SWIMMING POOL

[76] Inventor: Alfonso J. Cellini, 11 Wheeler Ct., Deer Park, N.Y. 11729

[21] Appl. No.: 752,607

[22] Filed: Dec. 20, 1976

[51] Int. Cl.[2] ..... E04H 3/20

[52] U.S. Cl. ..... 15/1.7; 15/341

[58] Field of Search ..... 15/1.7, 341, 344, 350; 21/127; 141/24–26, 28; 210/207, 169; 99/345, 346

[56] References Cited

U.S. PATENT DOCUMENTS

| | | | |
|---|---|---|---|
| 257,779 | 5/1882 | Stewart et al. | 15/341 |
| 612,612 | 10/1898 | Lynds | 15/1.7 |
| 946,832 | 1/1910 | Whitehouse | 15/341 |
| 971,044 | 9/1910 | Hutchinson | 15/341 X |
| 971,054 | 9/1910 | Lewis et al. | 15/341 |
| 1,101,541 | 6/1914 | Harrington | 15/1.7 |
| 1,161,087 | 11/1915 | Tyler | 15/341 X |
| 3,820,182 | 6/1974 | Vockroth | 15/1.7 |

FOREIGN PATENT DOCUMENTS

| | | | |
|---|---|---|---|
| 18,899 of | 1911 | United Kingdom | 15/341 |

*Primary Examiner*—Edward L. Roberts

*Attorney, Agent, or Firm*—Stanley Ira Laughlin

[57] ABSTRACT

Cleaning apparatus for cleaning selected small areas of a swimming pool comprising hand operated vacuum inducing means, water inlet tubes attached to the vacuum inducing means, and debris retaining and removal means within said tubes.

1 Claim, 3 Drawing Figures

CLEANING APPARATUS FOR SELECTED SMALL AREAS OF A SWIMMING POOL

BACKGROUND OF THE INVENTION

The invention relates to apparatus for cleaning swimming pools and more particularly to hand tools for cleaning small areas of the swimming pools.

Vacuuming apparatus for cleaning swimming pools is well-known. However, such equipment is heavy, bulky and is not convenient for easily removing a single stone, leaf, or even a small but annoying segment of phlegm floating in the pool. Nets, skimmers and other similar equipment, supposedly designed for these objects, can try the patience of even the most hardy pool owner.

Hand cleaning tools such as taught in U.S. Pat. No. 1,161,087 to Tyler and U.S. Pat. No. 1,212,815 to Roth are easily distinguished over Applicant's invention in that such hand operated vacuuming equipment is not applicable to cleaning swimming pools.

SUMMARY OF THE INVENTION

It is an object of Applicant's invention to provide simple, safe, and economical means for cleaning stones and other small, scattered debris from an otherwise clean swimming pool.

It is a further object of Applicant's invention to provide apparatus that is not heavy or cumbersome in its use.

It is a further object of Applicant's invention to provide apparatus that requires no particular skill in cleaning stones or small debris from a swimming pool.

Apparatus for selectively cleaning scattered, small debris from small areas of a swimming pool comprises a hand operated vacuum inducing means such as a bellows or syringe which is portable, a flexible or rigid tube of varying lengths that may be attached to the vacuum inducing means, and a debris retainer that is positioned within the tube. Placing the tube in the pool in some proximity to the debris that has been selected for removal insures success when air is expelled from the hand operated vacuum means and the resulting suction moves the water and debris into the tube where it is prevented from dropping out of the tube by the debris retainer. Subsequently, the tube with the trapped debris is removed from the swimming pool, and the trapped debris is thrown away.

DETAILED DESCRIPTION OF THE INVENTION

Figure 1:
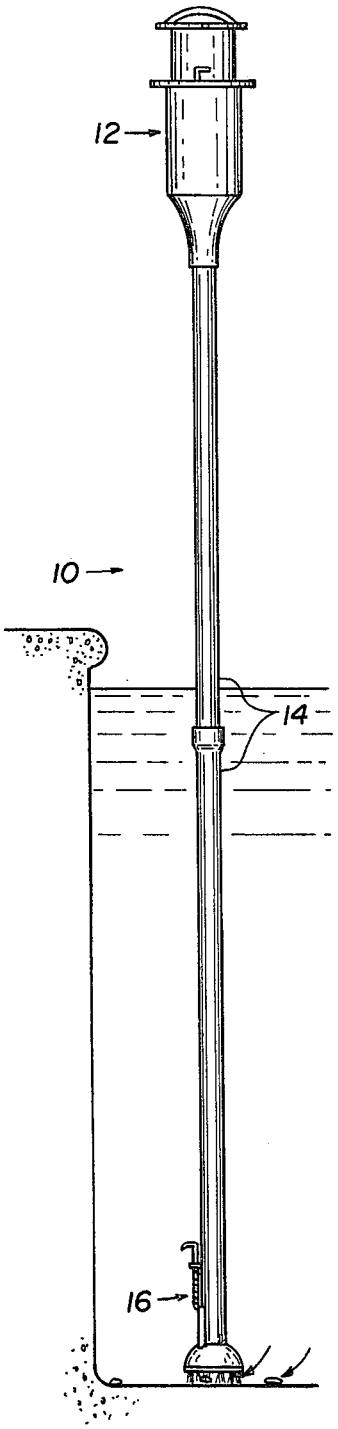
FIG. 1 is a isometric drawing of Applicant's Cleaning Apparatus.
Figure 2:
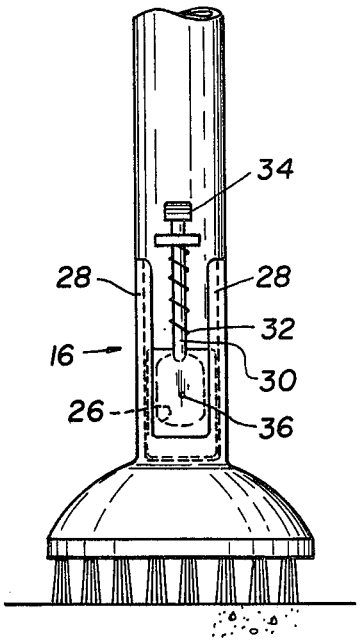
FIG. 2 is a detailed drawing of FIG. 1.
Figure 3:
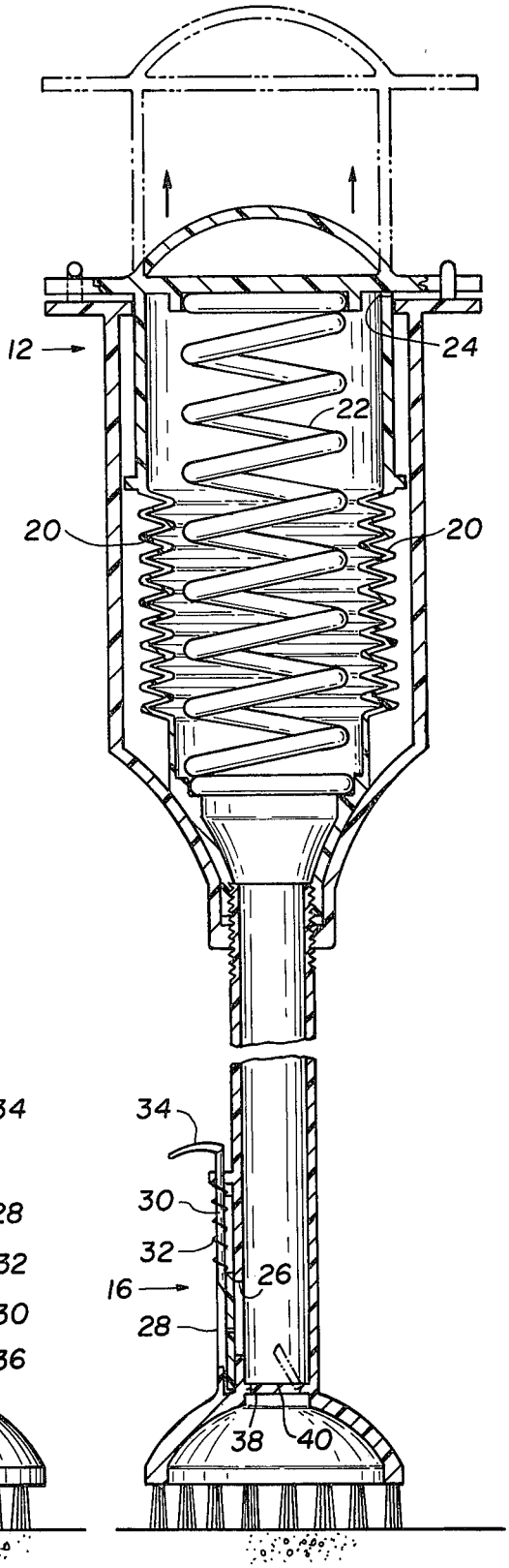
FIG. 3 is a detailed drawing of another view of the debris retainer of FIG. 1.

The apparatus 10 for selectively cleaning small areas of a swimming pool as shown in FIG. 1 comprises a hand operated vacuum inducing means 12 shown in detail in FIG. 3, water inlet tube 14 attached in a water-tight manner to the vacuum inducing means and debris retaining and removal means 16. The vacuum inducing means 12 is in one embodiment shown as comprising an air chamber 18 and a flexible bellows 20 employing a spring 22 for partially expelling the air from the air chamber through ports 24. The vacuum inducing means may employ conventional means for swiveling about tubes 14. As many lengths of tube 14 as is practical may be connected by means of any of the conventional water-tight disconnects available. The debris retaining and removal means 16 shown in FIGS. 2 & 3 is necessary to prevent the water and debris sucked into tube 14 from dropping out when the tube is removed from the water. The debris retaining and removal means 16 comprises a sliding door 26 in tube 14. The door 26 is secured to the tube 14 by means of grooves 28. A rod 30, encircled by a spring 32 for spring loading the rod and terminating in a hook 34 extending outward is fastened to the door 26. A pinhole 36 is provided in the door 26 to enable the escape of air trapped in the tube 14. A ring 38 for retaining a one way flap 40 in tube 14 is positioned proximate to sliding door 26. The flap 40 has openings therein to allow passage of water therethrough but prevents passage of debris out of said tube.

Operation of Applicant's apparatus is simple and merely comprises attaching the tube 14 as is required to the vacuum inducing means 12. The end of the tube 14 is placed in proximity to the debris to be removed, such as stones, as illustrated in FIG. 1. Compressing the bellows 20 expells air from the air chamber 18 and creates a vacuum therein since the tube 14 has been placed into the water. A resulting suction is thereby created as illustrated by the arrows in FIG. 1, resulting in the movement of the water, stones and other debris in the vicinity of tube 14 into tube 14, pass the debris retaining means 16. Removing tube 14 from the water, may cause, depending upon the leakage in the vacuum inducing means, the water, stones and other debris, to fall to the bottom of tube 14. However, debris retaining means 16 prevents this matter from dropping out of the tube 14 completely. Once tube 14 is taken out of the water, water can be returned to the pool, and the stones and other debris thrown away, by pressing the rim of a bucket against hook 34 and thereby sliding door 26 to an open position to empty the debris from the debris retaining and removal means 16.

Although only one embodiment of Applicant's invention has been illustrated, it can easily be seen that various modifications can be employed, such as flexible tubing, rubber syringes, and the like, to circumvent Applicant's invention. It is expected that Applicant be entitled to the scope and breadth of the following claims:

I claim:

1. Cleaning apparatus for a swimming pool comprising an elongated air chamber, said air chamber having a bellows as an integral part thereof, means for venting the air from said air chamber, a spring within said air chamber for maintaining said air chamber in an elongated condition, at least one length of tubing having water-tight means for connecting one end of said tubing to said air chamber, means extending upwardly from said tubing to limit movement of said air chamber in said elongated condition, said spring and said bellows expelling air through said air chamber venting means and said tubing by operating said spring in conjunction with said air chamber, flap means within said tubing for the passage of air and water away from said air chamber and allowing the passing of debris only in the direction toward said air chamber, preventing and retaining said debris from passing away from said air chamber through said tubing when air is expelled through said tubing from the air chamber, and allowing the passage of said air being expelled from said air chamber, and a water-tight, spring loaded sliding trap door on said tubing between said air chamber and said flap means proximate to said/flap means for selectively retaining said debris passing through said tubing.

* * * * *